US010641068B2

(12) United States Patent
Hardesty et al.

(10) Patent No.: US 10,641,068 B2
(45) Date of Patent: May 5, 2020

(54) PERFORATING GUN SYSTEM AND METHOD

(71) Applicant: GEODynamics, Inc., Millsap, TX (US)

(72) Inventors: John T. Hardesty, Weatherford, TX (US); Wenbo Yang, Kennedale, TX (US); Dennis E. Roessler, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 36 days.

(21) Appl. No.: 15/777,527

(22) PCT Filed: Nov. 30, 2017

(86) PCT No.: PCT/US2017/064038
§ 371 (c)(1),
(2) Date: May 18, 2018

(87) PCT Pub. No.: WO2018/144117
PCT Pub. Date: Aug. 9, 2018

(65) Prior Publication Data

US 2019/0330962 A1 Oct. 31, 2019

Related U.S. Application Data

(60) Provisional application No. 62/453,932, filed on Feb. 2, 2017.

(51) Int. Cl.
*E21B 43/119* (2006.01)
*E21B 43/117* (2006.01)

(52) U.S. Cl.
CPC ..... *E21B 43/119* (2013.01); *E21B 43/117* (2013.01)

(58) Field of Classification Search
CPC .... E21B 43/112; E21B 43/118; E21B 43/119; E21B 43/117
See application file for complete search history.

(56) References Cited

U.S. PATENT DOCUMENTS 4,153,118 A 5/1979 Hart
5,505,260 A * 4/1996 Andersen ..... E21B 17/1014 166/278

(Continued)

FOREIGN PATENT DOCUMENTS

CN 105392961 A 3/2016

OTHER PUBLICATIONS

International Search Report in International Application No. PCT/US17/64038 dated Feb. 13, 2018. (All references not cited herewith have been previously made of record.).

(Continued)

*Primary Examiner* — D. Andrews
(74) *Attorney, Agent, or Firm* — Patent Portfolio Builders PLLC

(57) ABSTRACT

A perforating gun system having gun sections coupled together with adapters. Each of the gun sections are adjustable to be offset relative to one another and each gun section is also decentralized with respect to the inside diameter of the wellbore casing. Each of the gun sections are movable in succession to an interval in the wellbore casing to create perforations such that the percentage of the casing openings is large for substantial fluid flow. The alignment and diameters of the gun sections are chosen to occupy the entire inner diameter of the casing.

30 Claims, 6 Drawing Sheets

(56) References Cited

U.S. PATENT DOCUMENTS

| | | | | |
|---|---|---|---|---|
| 6,298,915 | B1 | 10/2001 | George | |
| 6,347,673 | B1 | 2/2002 | Dailey | |
| 6,837,310 | B2 | 1/2005 | Martin | |
| 7,131,497 | B2 | 11/2006 | Helms et al. | |
| 8,291,973 | B2 | 10/2012 | Johnson et al. | |
| 8,327,746 | B2 | 12/2012 | Behrmann et al. | |
| 2001/0001984 | A1 | 5/2001 | Petegem et al. | |
| 2002/0162657 | A1* | 11/2002 | Tumlin | E21B 33/134 166/285 |
| 2007/0240599 | A1 | 10/2007 | Pratt et al. | |
| 2010/0012312 | A1* | 1/2010 | Ochoa | E21B 43/103 166/55.8 |
| 2010/0051278 | A1 | 3/2010 | Mytopher et al. | |
| 2010/0269676 | A1 | 10/2010 | Behrmann et al. | |
| 2011/0226468 | A1 | 9/2011 | Johnson et al. | |
| 2015/0152704 | A1* | 6/2015 | Tunget | E21B 33/128 166/254.2 |
| 2015/0226044 | A1 | 8/2015 | Ursi et al. | |
| 2015/0267516 | A1 | 9/2015 | Hardesty et al. | |
| 2016/0168961 | A1 | 6/2016 | Parks et al. | |
| 2016/0208587 | A1 | 7/2016 | Hardesty et al. | |
| 2016/0348484 | A1 | 12/2016 | Allison et al. | |

OTHER PUBLICATIONS

Office Action in China Application No. 201780003927.2 dated Jan. 23, 2019. ( All references not cited herewith have been previously made of record.).

Office Action in Canadian Application No. 3,004,273 dated Jun. 22, 2018.

International Search Report and Written Opinion of the International Searching Authority (ISA/US) dated Feb. 13, 2018.

Extended European Search Report in corresponding/related European Application No. 17 861 208.1 dated Aug. 22, 2019. (References not cited herewith have been previously made of record).

Chinese Office Action for related Chinese Application No. 201780003927.2 dated Aug. 20, 2019, including an English translation.

* cited by examiner

PERFORATING GUN SYSTEM AND METHOD

CROSS-REFERENCE TO RELATED APPLICATIONS

This non-provisional application claims priority to, relies on, and has been filed within the twelve months of the filing date of U.S. Provisional Patent Application Ser. No. 62/453,932, filed Feb. 2, 2017, entitled "PERFORATING GUN SYSTEM AND METHOD," the technical disclosure of which is hereby incorporated by reference in its entirety.

FIELD OF THE INVENTION

The present disclosure relates generally to perforation guns that are used in the oil and gas industry to explosively perforate well casing and underground hydrocarbon bearing formations, and more particularly to an improved gun system and method for maximizing percent casing removal in an interval in the well casing.

BACKGROUND

In cased wellbore operations, it is typical to use two or more concentric casings which decrease in diameter with increased wellbore depth. Perforation guns may be used during production and abandonment after production has ceased. Production requires perforations in the inner most casing of the concentric casings which has the smallest diameter and is located at the largest depth (downhole) of the wellbore relative to the other casings. Abandonment requires perforations in casings that typically have larger diameters and are located at a shallower depth (uphole) relative to the perforations made during production.

For example, during a cased wellbore completion process, a gun string assembly is positioned in an isolated zone in the wellbore casing. The gun string assembly comprises a plurality of perforating guns coupled to each other using connections such as threaded tandem subs. The perforating guns are then fired, creating holes through the casing and the cement and into the targeted rock. These perforating holes then allow fluid communication between the oil and gas in the rock formation and the wellbore. During the completion of an oil and/or gas well, it is common to perforate the hydrocarbon containing formation with explosive charges to allow inflow of hydrocarbons to the wellbore. These charges are loaded in a perforation gun and are typically "shaped charges" that produce an explosively formed penetrating jet that is propelled in a chosen direction, when detonated. When a charge in a perforating gun system is detonated and the well perforated, entrance holes are created in the well casing and explosives create a jet that penetrates into the hydrocarbon formation. The diameter of the entrance hole depends on several factors including but not limited to the nature of the liner in the shaped charge, the explosive type, the thickness and material of the casing, the water gap in the casing, centralization of the perforating gun, number of charges in a cluster and number of clusters in a stage. The term "water gap" used herein is a clearance between the outer diameter of a perforating gun and the inside diameter of a casing.

Perforation also takes place after production has ceased and the wellbore is prepared for abandonment. For example, during abandonment operations, often referred to as "plug-and-abandonment," perforations are required to open a section of the casing in order to deposit a sealant, such as cement. This is intended to prevent fluids from production in the downhole casing from migrating toward the surface where it could potentially contaminate water tables. Adequate perforation creates as many large openings in the intended section of casing as possible. In order to achieve this, a selected interval may be perforated with a gun system, followed by removal of the gun system. It is desired to have an improved gun system that is able to achieve adequate openings in the casing that is time and cost effective.

SUMMARY OF THE INVENTION

In accordance with an exemplary embodiment, there is provided a perforating gun system with gun sections coupled together. The gun sections are adjustable relative to one another and may be offset relative to adjacent sections. And, each of the gun sections are configured to be movable in succession to a predetermined position in a wellbore so that each gun section may perforate the same interval. Further, each of the of gun sections may be coupled together such that an axial center line of each gun section is mechanically adjustable relative to an axial centerline of directly adjacent gun sections.

In accordance with a another aspect, there is provided an exemplary embodiment of a method for perforating that includes the steps of (1) deploying the gun system having at least two gun sections into the well casing; (2) positioning a first gun section of the at least two gun sections at the predetermined position in the well casing; (3) perforating at the predetermined position with a first gun section; (4) moving a next gun section in the perforating gun system to the predetermined position in the well casing; (5) perforating at the predetermined position with the next gun section; and (6) repeating steps (4) and (5) until all the gun sections perforate at the predetermined position.

The foregoing is a brief summary of some aspects of exemplary embodiments and features of the invention. Other embodiments and features are detailed here below and/or will become apparent from the following detailed description of the present disclosure when considered in conjunction with the accompanying drawings.

BRIEF DESCRIPTION OF THE DRAWINGS

The novel features believed characteristic of the invention are set forth in the appended claims. The figures are schematic and illustrate aspects of exemplary embodiments. Figures are not intended to be drawn to scale. In the figures, each identical, or substantially similar component that is illustrated in various figures is represented by a single numeral or notation. For purposes of clarity, not every component is labeled in every figure. Nor is every component of each embodiment of the invention shown where illustration is not necessary to allow those of ordinary skill in the art to understand the invention.

DETAILED DESCRIPTION

As a preliminary matter, the term "area open to flow" as used herein is the total area of holes created by perforation in the casing. The term "percent casing removal" used herein is a ratio of the area open to flow within a desired interval and the total interior surface area of the casing along the desired interval. For example, in abandonment operations, an often desired percent casing removal is 2.5% or greater. Allowing such an adequate percent casing removal in a single trip down a wellbore is desirable because it reduces costs and time that is typically required when more than one trip is made to perforate. Moreover, achieving even higher percent casing removal allows for robust plug and abandonment of a well to prevent leakage of fluids from the casing below the plug.

To facilitate the discussion and description of the various embodiments of the perforating gun system, descriptive conventions may be used to describe the relative position or location of the features that form the perforating gun system as well as relative direction. For example, the terms "downhole" and "uphole" will be used to describe the locations (vertical displacement) relative to a point of reference in a wellbore. For example, production typically takes place downhole from the predetermined depth (the "point of reference," in this example) to create a plug, and the plug depth is created uphole from the production depth. Moreover, a first plug may be created downhole from an additional, more uphole plug to ensure additional blockage of fluid migration. For example, the terms "near side" and "high side" describe inner circumferential locations on a casing relative to a gun section. The term "near side" refers to the side of the casing to which the perforating gun system is most proximate, and the term "high side" refers to the side of the casing which the perforating gun is farthest away from. For example, the water gap from the outer diameter of a perforating gun to a high side of the casing is large compared to the water gap from the outer diameter of a perforating gun to a near side of the casing.

A potential cause for the differences between hole sizes between the high and near side of the casing is the jet formed by the deep penetrating and big hole charge in a typical perforating gun is not constant and a tip portion of the jet may get consumed in a water gap in the casing when a gun is decentralized (i.e. not located in the center of the casing string). Operators in the field often do not centralize (i.e. manipulate to the center of the casing string) a gun. As a result, the diameter of the entrance hole on one side of the casing to which the gun system is more proximate may be much greater than the diameter of the entrance hole on another side of the casing.

Figure 5:
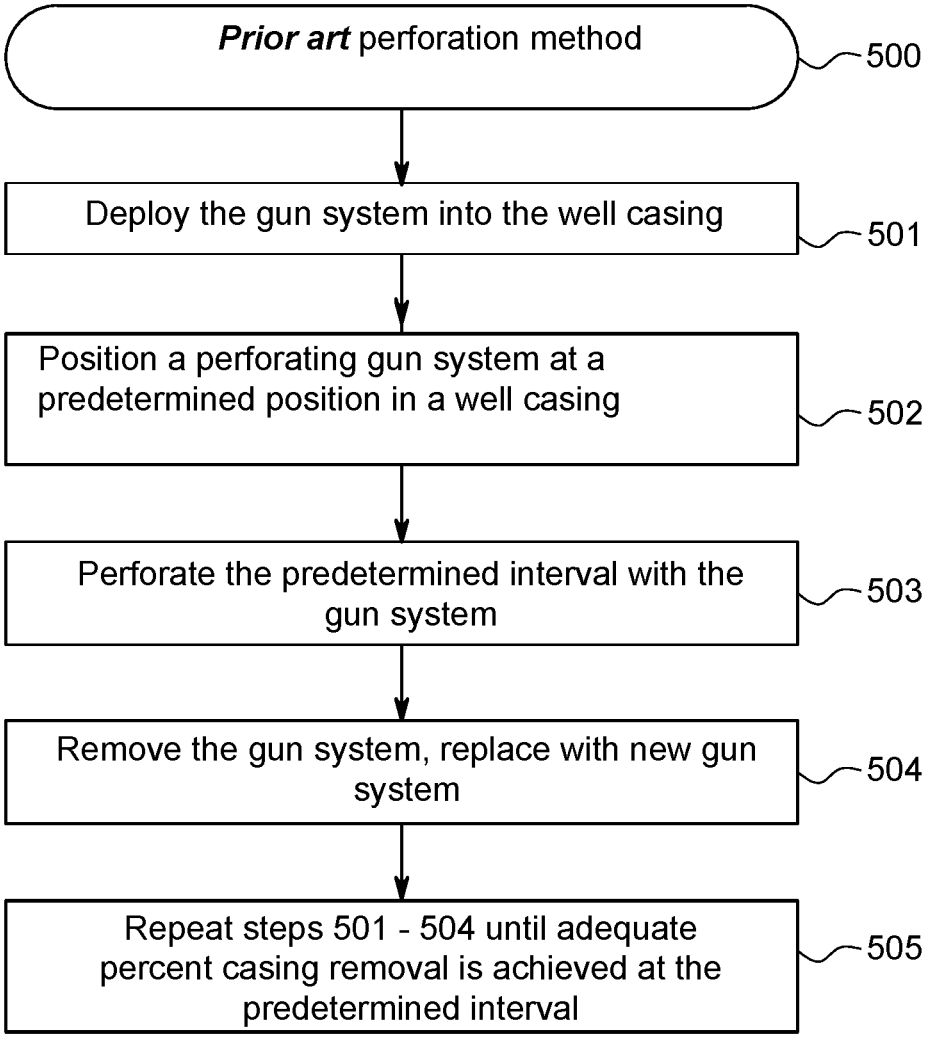
FIG. 5 is a flowchart of a perforating method using a typical gun system in the prior art.

For example, in a typical 13⅜ inch casing, the largest gun that is available is 7 inches in outer diameter. Once a gun is deployed, the diameter of the resulting holes may vary from 0.25 inches to 1.5 inches, depending on the proximity to the gun to the casing. Moreover, the total percent casing removal may not be adequate after a single entry. One possible way to achieve a greater casing removal is by making a much larger gun with an outer diameter that approximates the interior diameter of the casing, and thus reduces the water gap. Large diameter guns have several design constraints, for example, they may have increased wall thickness to withstand additional pressure. Such constraints may become more costly with diminishing returns on the added cost/investment. Another approach is to make two or more round trips by running a first gun down to the predetermined depth, perforating, and removing the first gun, and then running a second gun down and shooting the same interval. For example, FIG. 5 describes the prior art in a simplified flowchart of a perforating method using a typical gun system. The method includes the steps of:

(1) deploying the gun system into a well casing 501;
(2) positioning a perforating gun system at a predetermined position in a well casing 502;
(3) perforating at the predetermined position with a the gun system 503;
(4) removing the gun system, replacing with a new gun system 504; and
(5) repeating steps (1)-(4) until adequate percent casing removal is achieved at the predetermined interval 505.

The expected improvement with each additional trip is uncertain because some of the new perforations are likely to overlap with prior perforations in an unpredictable manner. Moreover, when the subsequent gun systems are run down the casing, it is also possible to create holes on the side of the casing that already has small holes, and to create bigger holes on the side of the casing that already has big holes. This is not ideal for increasing the percent casing removal. Running the perforating guns in multiple trips is also costly and time consuming because each round trip typically takes additional days. Once an exemplary gun system of the present disclosure is positioned into a well casing, a specific gun section will have a fixed orientation with respect to the well casing relative to each successive gun section such that the pattern of perforations, hole size distribution, and degree of perforation overlap amongst gun sections is known. In one exemplary embodiment, non-overlapping patterns of perforations may be created. In another exemplary embodiment, the extent of perforation overlap in a pattern is fixed prior to perforating.

Figure 1:
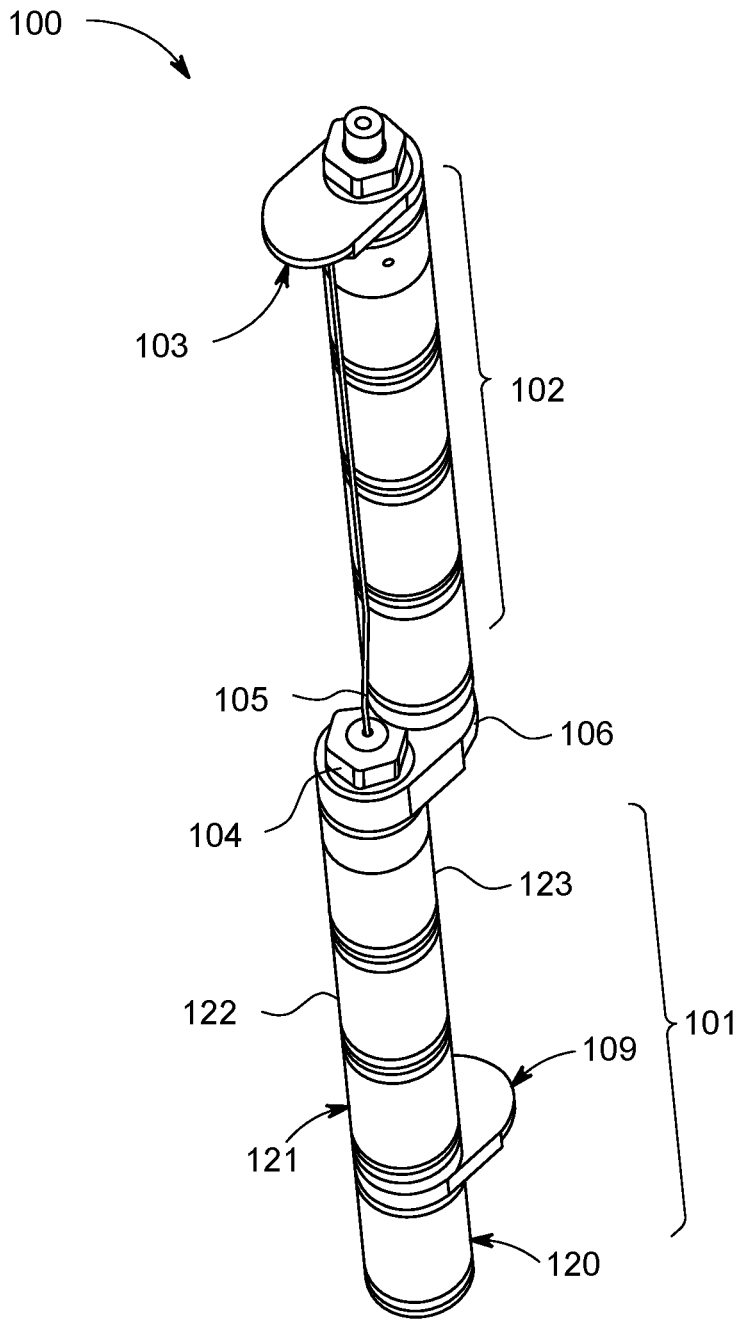
FIG. 1 is a perspective view of a 2-section gun system in accordance with an illustrative exemplary embodiment.

FIG. 1 is a perspective view of a 2-section gun system in accordance with an illustrative exemplary embodiment. The 2-section gun system 100 may include a string of gun sections 101, 102 mechanically coupled to one another using adapter 106. According to an exemplary embodiment, the gun system 100 may be deployed using tubing conveyed perforating. According to an exemplary embodiment, the gun system deployed using tubing conveyed perforating prevents guns from rotating as they are repositioned up and down the well casing and the adapter 106 prevents rotation and separation between the gun sections 101 and 102. The gun system may be placed on the end of tubing or a steel pipe, for example, and run into a well, and the tubing may be pushed downhole against the well pressure. For example, coil tubing may be used to deploy the gun system depending on weight limitations. After a gun system is placed into the wellbore casing, the gun sections 101, 102 may be decentralized in the casing with spacers 103, 109. A "spacer" may be attached to each gun section in order to locate that gun section more precisely within the casing interior. Thus, the spacers ensure that each gun section is close to an inner surface area of the casing and reduces the water gap between the gun section and the closest interior of the casing. When the outer diameter of a gun is small in comparison to the inner diameter of the casing, a perfectly centralized perforation gun with uniform water gap around the gun may result in a lower percent casing removal as compared to guns that are positioned decentralized in order to minimize water gap at an inner circular arc of the casing. So, the spacers are used to prevent centralization of each section of the gun system.

The well casing may be installed in a vertical or horizontal or deviated well. In an exemplary embodiment, for ease of explanation, the gun system is deployed in a vertical well. In the exemplary embodiment of FIG. 1, the spacer 109 may be extending outward in one direction radially from the gun section, and the other spacer 103 may be pointing 180° in the opposite direction. As can be seen, the spacers may be manipulated by extending them to point outward in a wide range of angles and/or orientations relative to each other. Accordingly, in a two gun section system, the gun sections are decentralized in a predetermined manner and each gun section is offset relative to directly adjacent gun sections.

The gun system 100 may have a first gun section 101 and a second gun section 102 connected to each other through an adapter 106. For example, each of the gun sections 101, 102 may be designed with 7" outer diameter guns with proven 39-60 gram charges for optimum casing removal. Other dimensions and charges may be useful, of course, depending upon the particular project. Moreover, in a non-limiting example, an exemplary gun system may have 12, 15, or 20 shot per foot ("SPF") shot density, and spiral phasing of charge in order to simplify assembly, along with other possible shot densities. It may be appreciated that an exemplary gun system may be capable of many possible shot densities and may also be fully or partially loaded, such that perforations are created around the entire inner wellbore diameter each time a gun is fired, or such that perforations are only created at a minimum water gap, or such that perforations are only created at maximum water gap. In an exemplary embodiment, each gun section may be configured with distinct shot loads from one another, for example, all gun sections may be partially loaded or all sections may be fully loaded. For example, one gun section may be oriented to create perforations at a minimum water gap and another gun section may be oriented to create perforations at a maximum water gap. For example, two or more gun sections may be oriented to create perforations in all directions inside the inner circular arc of the casing. For example, two or more gun sections may be oriented at the same inner circular arc of a casing with a minimum water gap or a maximum water gap. In another exemplary embodiment, each gun section may be configured with the same shot loads from one another, for example, each gun section may have various loads ranging from partially loaded to fully loaded. For example, one gun section may be oriented to create perforations at a minimum water gap and another gun section may be oriented to create perforations in all directions inside the inner circumference of the casing.

According to an exemplary embodiment, the gun sections are connected together with adapter 106 configured to prevent the gun sections from rotating relative to each other and separating from adjacent gun sections. A retaining nut 104 may be used to secure the adapter 106 to a gun section. Each of the gun sections may have multiple perforating guns connected to each other along with a firing head. The guns may not be rotated during the connection process. In some instances an individual gun of a gun section can be rotated such that a slight angular offset exists between adjacent individual guns of that gun section. For example, gun section 101 may have gun 120, gun 121 and gun 122 connected to each other, with a firing head 123 at one end. Gun 120 may be connected to gun 121 via a spacer 109. According to an exemplary embodiment, a diameter of the guns in the gun sections may range from 5 inch to 12 inches, albeit that all the guns in a gun section have the same diameter. Each of the guns may be coupled to one another using any configuration known in the industry. The guns may further include shaped charges phased spirally. The shaped charges may be connected to a detonating cord 105 and a firing assembly, as generally used in the perforating gun systems. The shaped charges may be selected from a deep penetrating, deep hole, linear, or any other charges generally available for perforation. According to an exemplary embodiment, the number of gun sections ranges from 2 to 10. According to another exemplary embodiment, a number of guns in each of the gun sections ranges from 2 to 20.

As indicated above, a control line 105 may be connected to the system and configured to function as generally known in the industry. The firing heads or gun sections may be self-isolating after firing. The term "self-isolating" is used herein to describe a feature of each gun section to disconnect or modify its communication with the gun system upon adequate change of pressure after firing and prior to invasion of conductive fluids into the gun section. For example, a system is self-isolating if when detonated or functioned, a gun section or a firing mechanism on a gun section is modified such the functioned gun section does not communicate with the pressure actuated firing mechanism such as a control line or tubing. This allows the line to be used to increase pressure on a subsequent gun section. For example, if the gun section or section firing mechanism does not isolate upon function, then it might be difficult to produce the pressure in the control line necessary to function the subsequent gun sections. According to an exemplary embodiment each of the at least two gun sections may be individually actuated. Moreover each of the at least two gun sections gun sections may be self-isolating after perforating.

According to an exemplary embodiment, each of the at least two gun sections gun sections may be armed with hydrostatic pressure in the well casing. According to another exemplary embodiment, each of the at least two gun sections gun sections are configured to not arm without hydrostatic pressure.

According to an exemplary embodiment, each of the at least two gun sections gun sections may be connected to one or more control lines. According to an exemplary embodiment, a portion of a circumference of each of the plurality of gun sections may be in overlapping relation, as viewed from above, with other gun sections within the well casing. When the gun system is deployed downhole, at a predetermined depth, hydrostatic pressure may open the shut-off valve, and arm the guns. The firing head may not be fired without the shut-off valve opened. The pressure may be applied on the annulus outside the gun. The shut off valve would allow the pressure from the tubing to act on the top of the firing pins only if the annulus pressure applied from outside the gun (hydro static pressure) is sufficient enough to open the shut off valve. Pressuring up the casing may shear the lower firing head pins 152 and shoot lower first gun section 101 in a certain interval. The upper second gun section 102 may then be positioned in the same interval and perforation may be performed in the same interval. The gun system may be retrieved following the perforation of the same interval by both the gun sections 101, 102. The casing is perforated by two gun sections in the same interval at different circumferential arcs of the inside of the casing. While the gun section 101 is positioned closer to the bottom circumferential arc of an inside surface of the casing, the gun section 102 is positioned closer to the top circumferential arc of an inside surface of the casing. Each of the gun sections may perforate a different arc of the casing and create jets that penetrate a water gap. In the case of a 2-section gun system with spacers 103, 109 the gun section 101 may create larger holes on one side of the casing and the gun section 102 may create larger holes on the opposite side of the casing when the gun sections perforate the same interval. The net effect of creating bigger holes on opposing sides of the casing by two gun sections is a substantially larger percent casing removal.

According to an exemplary embodiment, a water gap for each gun section may range from 0.1 inch to 15 inches, for example, in a 20 inch casing. The guns sections may overlap each other diametrically (i.e. as seen from above, in an end view, their diameters may overlap) but they are each positioned against different circumferential arcs of the casing. The percentage of the casing removal created by the gun sections in the same interval is substantially higher than two gun sections which are centered relative to one another. For example, in a 200 feet interval intended to be perforated, a 2-section gun system may be 400 feet long with 10×20 foot guns in each section and a firing head section. With the exemplary 2-section gun system, a casing removal of at least 2.5% may be achievable. And, with the exemplary 3-section gun system, a casing removal of at least 3.75% may be achievable. In comparison, using a single section gun system the casing removal may be typically 1.25%. A percentage of the casing opened for substantial fluid flow using the exemplary embodiment ranges from 1.5 to 10 in the desired interval. Further, the desired perforating interval of perforating may range from 20 feet to 600 feet in length.

Each individual gun may have a number of different shot densities. For example, a 7 inch outer diameter gun may be capable of a shot density of 12 SPF (shot per foot), 15 SPF, 20 SPF, or any other shot densities available. As the charges are clocked around the casing using spiral phasing, about a 90° arc of the gun positioned closest to the interior of the casing provides large hole sizes. Depending on the type of gun and shot density, the phasing for each gun varies. For example, the phasing for a 12 SPF gun may be 135-45 degrees, the phasing for a 15 SPF may be 135-45 degrees and the phasing for a 20 SPF gun may be 45-90 degrees or 135-45. In another exemplary embodiment, any phasing known in the industry may be used that positions the detonating cord near centerline, for example, 3 per plane, 4 per plane, 5 per plane, and the like. In another exemplary embodiment, clocking is not used. In another exemplary embodiment, every gun section is the same type of gun configured with the same shot density capability and the same phasing capability. In another exemplary embodiment, every gun section is not the same type of gun and are not necessarily configured with the same shot density capability or the same phasing capability.

According to an exemplary embodiment, a gun system 100 for perforating a desired interval in a well casing has a plurality of gun sections connected together. Each of the at least two gun sections may be angularly offset relative to an adjacent section of the plurality of gun sections. Each of the at least two gun sections are positioned against different circular arc sections of an inside surface of the casing. When perforating, each of the at least two gun sections are configured to be moved to the desired interval to perforate and create openings such that a percentage of the casing is opened for wellbore operations. The wellbore operations may be fluid flow in production or squeezing cement through the openings in plug and abandonment operations.

In wellbore operations, a casing may have a top section, a middle section, and a production section. In a non-limiting example, the top section may be 20 inches in diameter, the middle section may be 13⅜ inches in diameter, and the production section may be 9⅝ inches in diameter. When, for example, a 7 in diameter gun is deployed for perforation, the water gap in the top section may be as high as 5 inches. In this example, a 2-section gun system 100 or a 3-section gun system 300 provides for greater than 2 percent casing removal. As a result, when cement is pumped into the casing for abandonment, the cement is squeezed through the casing openings into the surrounding bore hole. The casing in the middle section and top section may be opened with the inventive gun systems and provide for at least a 1% casing opening. Similarly, with a smaller gun diameter, for example 4 inches, the production section may be perforated with the exemplary gun systems to enable substantial fluid flow during production.

Figure 2:
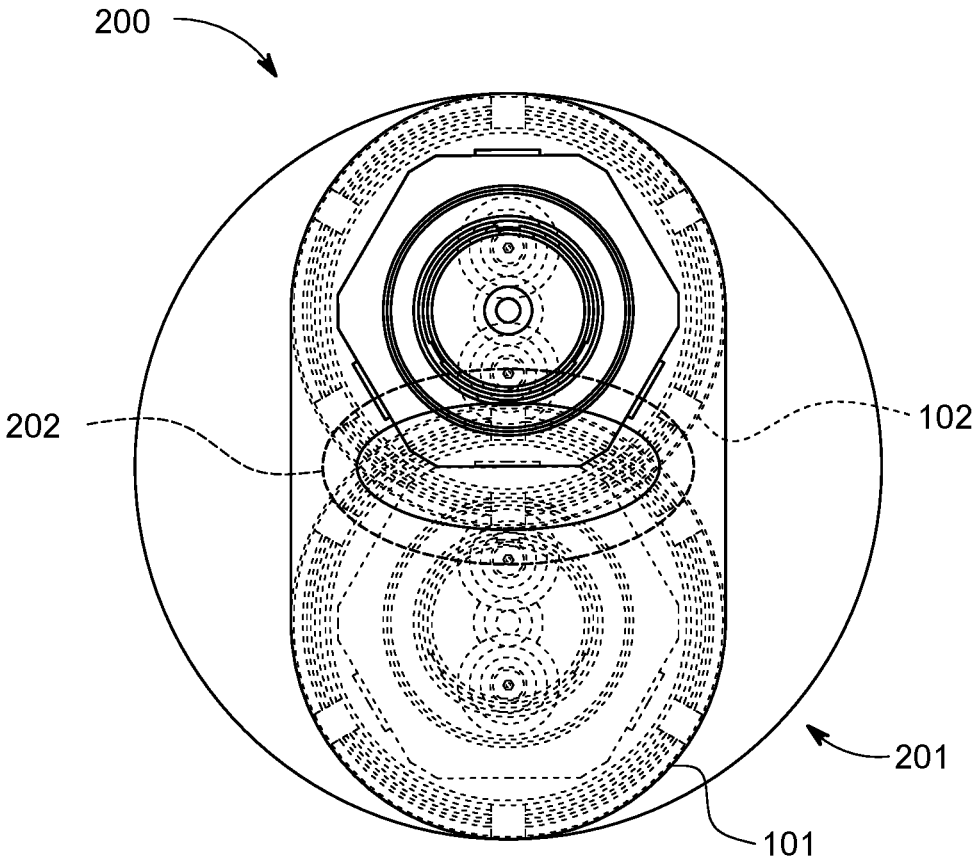
FIG. 2 is an end view of a 2-section gun system in accordance with an illustrative exemplary embodiment.

FIG. 2 is an illustrative end view of a 2-section gun system in accordance with an embodiment. The gun section illustrates gun section 101 and gun section 102 positioned against an inner section of a well casing 201. Gun section 101 may be angularly offset relative to the adjacent gun section 102. For example, gun section 101 is angularly offset by 180 degrees relative to the adjacent gun section 102. The diameter of gun section 101 and gun section 102 may overlap and create an overlapping section 202. According with an exemplary embodiment, a range of angular offset of each of the plurality of gun sections with respect to an adjacent gun section ranges from 30 degrees to 180 degrees. In a non-limiting example, the outer diameter of each of the sections may be 7 inches, but the effective diameter of the combined gun system may be 12 inches as depicted in FIG. 3.

Figure 3:
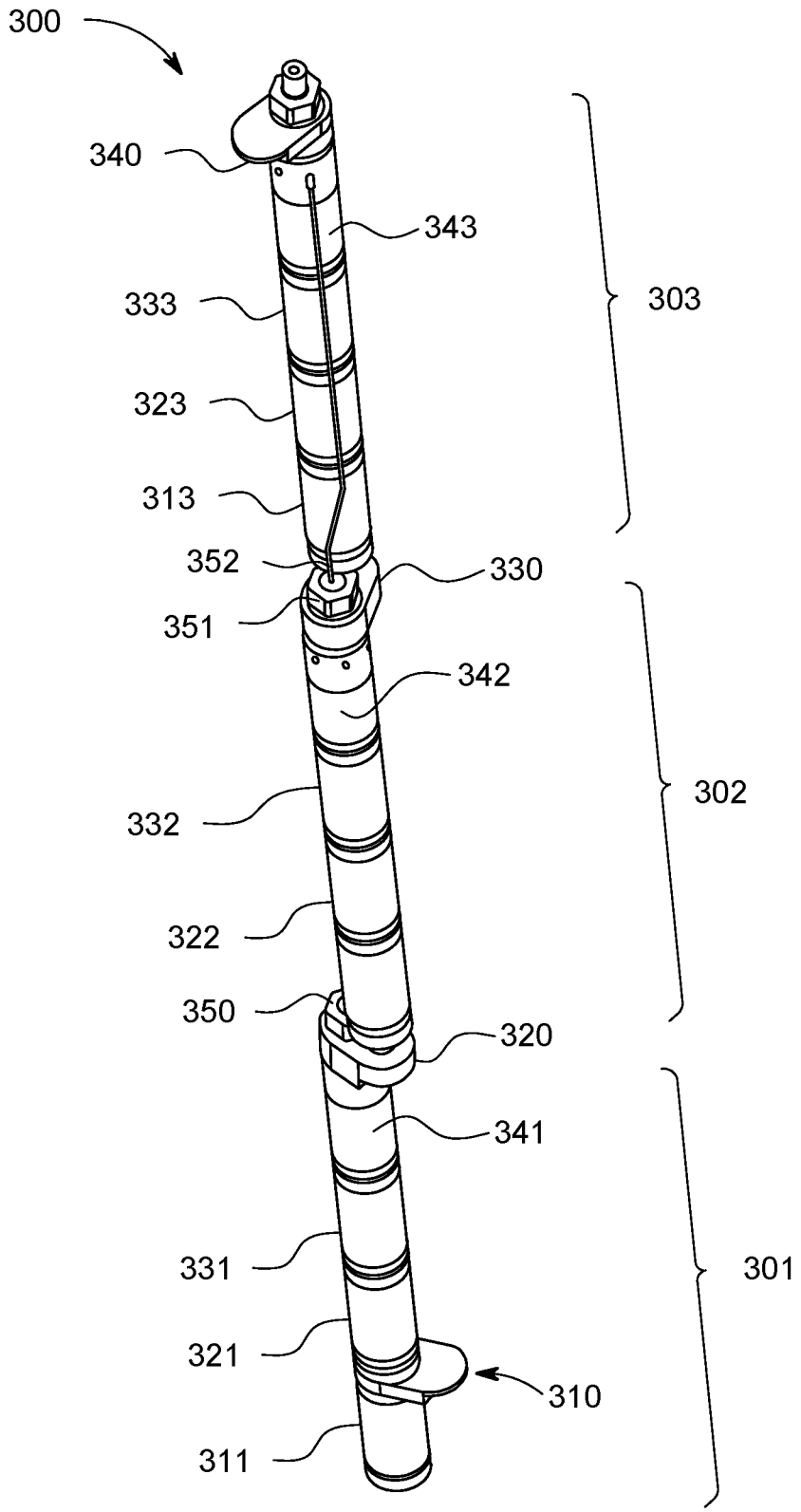
FIG. 3 is a perspective view of a 3-section gun system in accordance with an illustrative exemplary embodiment.

FIG. 3 is a perspective view of a 3-section gun system in accordance with an exemplary embodiment. The gun system 300 may have a first section 301, a second gun section 302, and a third section 303 connected to each other through adapters 310 and 340 end-to-end in a vertical array. Retaining nuts 350, 321 may be used to secure adapters 320, 330 to the gun sections. Each of the gun sections may include multiple perforating guns connected to each other along with a firing head. The guns are generally held so that they may not be rotated during the connection process. In some instances, however, the gun can be rotated such that a slight angular offset exists between adjacent guns in the same gun section. Referring to FIG. 3, gun section 301 may have gun 311, gun 321, and gun 331 connected to each other along a vertical string a firing head 341 attached to an end of the gun section 301. Similarly, gun section 302 may have gun 321, gun 322, and gun 332 connected to each other along with a firing head 342 attached to one end of the gun section 302. Likewise, gun section 303 may have gun 313, gun 323, and gun 333 connected to each other along with a firing head 343 attached to one end. A control line 352 may be disposed on the outer surface of the gun sections such that the lower most guns are fired and isolated after firing. In an exemplary embodiment, a control line 352 runs from the firing head 343 of a top gun section 303 to a firing head 441 of the bottom most gun section 301 and a control line 352 may run from a firing head 442 of a mid-gun section 302 to the top of the firing head 441 of the lowest gun section 301. Another aspect of the an exemplary embodiment is that the lowest gun section 301 may be fired first, then the mid-gun section 302, and finally the top gun section 303. This prevents prematurely perforating a control line uphole required in a downhole section of the gun system. Gun section 301 may be angularly offset to gun section 302 by 120 degrees 305. Similarly, gun section 302 may be angularly offset to gun section 303 by 120 degrees 305 and gun section 301 may be angularly offset to gun section 403 by 120 degrees 305. In an exemplary embodiment, it is possible to customize the degree of offset positions between the gun sections. For example, a first pair of adjacent gun sections may be aligned with one another and offset relative to a third gun section.

Figure 4:
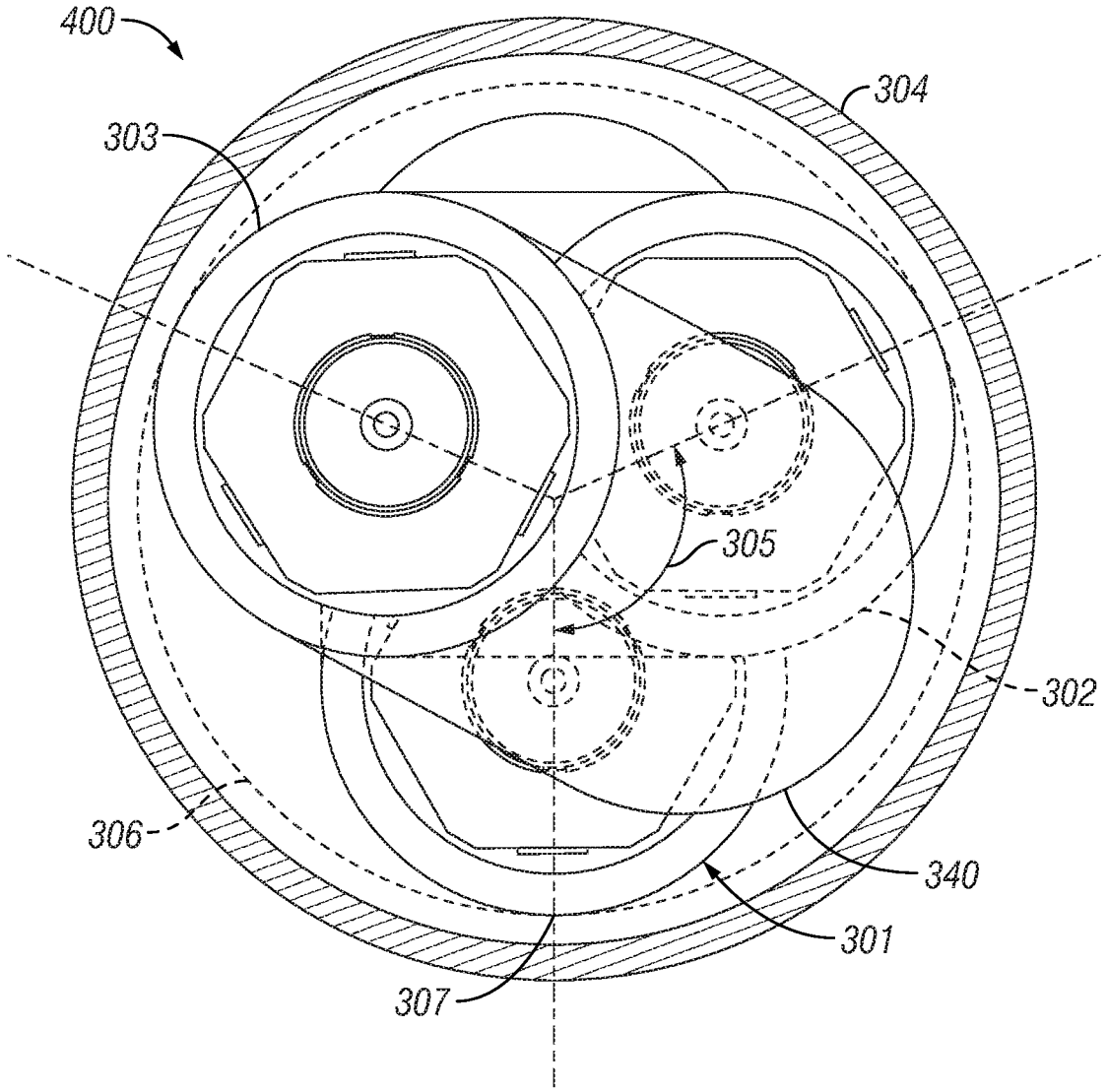
FIG. 4 is end view of a 3-section gun system in accordance with an illustrative exemplary embodiment.

FIG. 4 is an illustrative end view of a 3-section gun system in accordance with an exemplary embodiment. As pointed out, the gun system may be deployed in a casing 304 installed in a well. The diameters of the gun sections may overlap and create overlap sections. In exemplary embodiment, the overall diameter 306 of the gun system is 12 inches. The guns sections in the 3-section gun system may be clocked at 120° relative to one other. The gun sections 301, 302, 303 are positioned against (or nearest to) different circular arc sections of an inside surface of the casing, for example gun section 301 is positioned the inside surface of the casing 317. Moreover the overall gun system may be designed for easy change over between 2-section gun and 3-section gun system and any other additional gun sections may be easily added.

Figure 6:
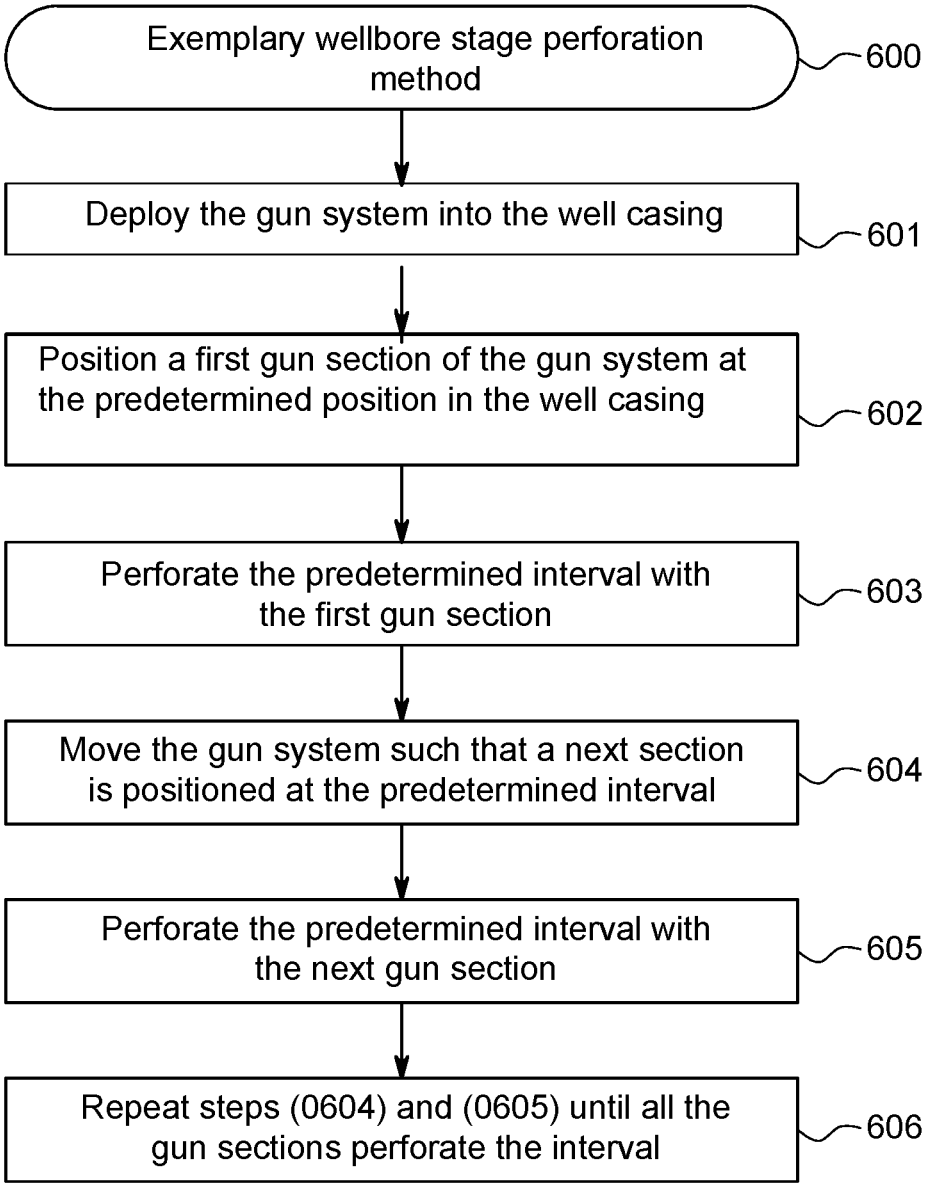
FIG. 6 is a flowchart of a perforating method using an exemplary gun system in accordance with the present inventions.

FIG. 6 is a simplified flowchart of a perforating method using an exemplary gun system of the present disclosure. The method includes the steps of:

(1) deploying the gun system into a well casing 601;
For example, the gun system 300 may be deployed into a casing using tubing conveyed perforating or a coiled tubing system.

(2) positioning a first gun section of the at least two gun sections at the predetermined position in the well casing 602;
The gun system 300 may be lowered such that the first gun section 301 is positioned at a predetermined depth of interest. For example in a vertical well, the predetermined "position" is at a predetermined "depth." At adequate depth, hydrostatic pressure will open the shut-off valve, and arm the guns in the gun sections. The shut-off valve is an added safety mechanism so that guns are disarmed during deployment or otherwise.

(3) perforating at the predetermined position with a first gun section 603;
At the desired interval the tubing may be pressured up. This may shear the lower firing head pins and shoot lower gun 311 in gun section 301 and the subsequent guns 321, 331 may be perforated with, or without, the control line. The guns may be self-isolating after perforation.

(4) moving a second gun section in the at least two gun sections to the predetermined position in the well casing 604;
The next gun section such as 302 may be positioned at the same predetermined position and pressured up again. At adequate depth, hydrostatic pressure will open the shut-off valve, and arm the guns in the gun sections.

(5) perforating the interval with the next gun section 605; and
Pressure the tubing at a higher pressure than the pressure in step 603 and shear the lower firing head pins and shoot lower gun 312 in gun section 302 and the subsequent guns 322, 332 may be perforated with or without the control line. The predetermined pressure of the shear pins of the gun section 302 may be higher than the predetermined pressure of the shear pins of the gun section 301.

(6) repeating steps (4) and (5) until all the gun sections perforate the predetermined position 606.
Gun section 303 may be moved to same predetermined position and perforation may be performed.

An exemplary embodiment of a 2-section gun system and 3-section gun system was compared with a 1-section gun system in a 13⅜" diameter casing. An interval perforated totaled 465 $in^2$ of interior casing surface area with water gaps around the gun sections ranging from 0.48 inches to 5.48 inches with corresponding hole sizes 0.93 $in^2$ and 0.12 $in^2$, respectively. The resulting percent casing removal for the single section gun was 1.25%, for the 2-section gun, the percent casing removal doubled to 2.50%, and for the 3-section gun, the percent casing removal was 3.75%.

The following descriptive embodiments are offered as further support of the disclosed invention:

In a first embodiment, novel aspects described in the present disclosure are directed to a perforating gun comprising: at least two gun sections coupled together, one of the at least two gun sections configured to be angularly offset relative to another of the at least two gun sections; wherein during use each of the at least two gun sections is configured to be movable in succession to a predetermined position, when deployed in a well casing.

In another aspect of the first embodiment, perforating gun system, the system comprising: at least two gun sections coupled together, one of the at least two gun sections configured to be angularly offset relative to another of the at least two gun sections; wherein during use each of the at least two gun sections is configured to be movable in succession to a predetermined position, when deployed in a well casing; and further comprises one or more limitations selected from the following:

wherein each of the at least two gun sections is configured to be angularly offset relative to adjacent ones;

wherein the at least two gun sections are coupled together such that an axial center line of each gun section is mechanically adjustable relative to an axial centerline of adjacent gun sections;

wherein each of the at least two gun sections are positioned proximate to different circular arc sections of an inside surface of a well casing;

wherein each of the at least two gun sections is configured to perforate different circular arc sections of an inside surface of a well casing;

wherein each of the at least two gun sections is configured to create new perforations without overlapping perforations made from another of the at least two gun sections;

wherein each of the at least two gun sections is configured to create new perforations overlapping at least one perforation made from another of the at least two gun sections;

wherein a cross-section of the perforating gun system has an outer diameter that approximates an inner diameter of the well casing;

wherein the at least two gun sections are connected together with adapters configured to prevent the gun sections from rotating or separating relative to each other;

wherein the at least two gun sections are decentralized with respect to the well casing;

further comprising a spacer attached to one or more of the at least two gun sections so each of the at least two gun sections are decentralized with respect to the well casing;

wherein the perforating gun system is deployed with tubing conveyed perforating;

wherein the perforating gun system is deployed with coil tubing;

wherein a number of individual guns in each of the at least two gun sections ranges from 2 to 20;

wherein a number of gun sections in the perforating gun system ranges from 2 to 3;

wherein the predetermined position spans an interval of perforating ranges from 20 feet to 600 feet;

wherein a water gap between an outer diameter for each of the at least two gun sections and the inner surface of a well casing ranges from 0.1 inch to 15 inches;

wherein an outer diameter of each of the at least two gun sections ranges from 5 inch to 12 inches;

wherein a percentage of a well casing removal in the interval ranges from 1.5 to 10;

wherein a range of angular offset of each of the at least two gun sections with respect an adjacent gun section ranges from 0 degrees to 180 degrees;

wherein each of the at least two gun sections are individually actuated;

wherein each of the at least two gun sections are self-isolating after perforating;

wherein each of the at least two gun sections are armed by hydrostatic pressure in the well casing;

wherein each of the at least two gun sections are armed using one or more timers;

wherein each of the at least two gun sections are connected to one or more control lines;

wherein a portion of a circumference of each of the at least two gun sections are overlapping with circumferences of other gun sections within the well casing; and wherein each gun section of the at least two gun sections is capable of a shot density of in the range of 12 to 20 shot per foot.

In a second embodiment, novel aspects of the present disclosure are directed to a perforating method comprising the steps of: (1) providing a perforating gun system comprising at least two gun sections coupled together, one of the at least two gun sections configured to be angularly offset relative to another of the at least two gun sections; (2) deploying the gun system into a well casing; (3) positioning a first gun section of the at least two gun sections at the predetermined position in the well casing; (4) perforating the predetermined position with the first gun section; (5) moving a next gun section in the at least two gun sections to the predetermined position in the well casing; (6) perforating the predetermined position with a next gun section; (7) repeating steps (5) and (6) until all the gun sections perforate at the predetermined position.

In another aspect of the second embodiment, novel aspects of the present disclosure are directed to a perforating method comprising the steps of: (1) providing a perforating gun system comprising at least two gun sections coupled together, one of the at least two gun sections configured to be angularly offset relative to another of the at least two gun sections; (2) deploying the gun system into a well casing; (3) positioning a first gun section of the at least two gun sections at the predetermined position in the well casing; (4) perforating the predetermined position with the first gun section; (5) moving a next gun section in the at least two gun sections to the predetermined position in the well casing; (6) perforating the predetermined position with a next gun section; (7) repeating steps (5) and (6) until all the gun sections perforate at the predetermined position; and further comprises one or more limitations selected from the following:

wherein the step of perforating includes detonating the gun section;

wherein the step of perforating includes detonating the gun section using a hydraulic connection;

wherein the predetermined depth in the well casing is at a point where a well is to be sealed and abandoned;

further comprising the step of repositioning the perforating gun system without rotating the perforating gun system;

further comprising the step of orienting each of the gun sections with respect to one another;

wherein each of the at least two gun sections is fully loaded;

wherein each of the at least two gun sections is partially loaded; and wherein each of the at least two gun sections uses a spiral phasing of charge.

Although the present disclosure has provided many examples of systems, apparatuses, and methods, it should be understood that the components of the systems, apparatuses and method described herein are compatible and additional embodiments can be created by combining one or more elements from the various embodiments described herein. As an example, in some embodiments, a method described herein can further comprise one or more elements of a system described herein or a selected combination of elements from any combination of the systems or apparatuses described herein.

Furthermore, in some embodiments, a method described herein can further comprise using a system described herein, using one or more elements of a system described herein, or using a selected combination of elements from any combination of the systems described herein.

Although embodiments of the invention have been described with reference to several elements, any element described in the embodiments described herein are exemplary and can be omitted, substituted, added, combined, or rearranged as applicable to form new embodiments. A skilled person, upon reading the present specification, would recognize that such additional embodiments are effectively disclosed herein. For example, where this disclosure describes characteristics, structure, size, shape, arrangement, or composition for an element or process for making or using an element or combination of elements, the characteristics, structure, size, shape, arrangement, or composition can also be incorporated into any other element or combination of elements, or process for making or using an element or combination of elements described herein to provide additional embodiments. For example, it should be understood that the method steps described herein are exemplary, and upon reading the present disclosure, a skilled person would understand that one or more method steps described herein can be combined, omitted, re-ordered, or substituted.

Additionally, where an embodiment is described herein as comprising some element or group of elements, additional embodiments can consist essentially of or consist of the element or group of elements. Also, although the open-ended term "comprises" is generally used herein, additional embodiments can be formed by substituting the terms "consisting essentially of" or "consisting of."

Where language, for example, "for" or "to", is used herein in conjunction with an effect, function, use or purpose, an additional embodiment can be provided by substituting "for" or "to" with "configured for/to" or "adapted for/to."

Additionally, when a range for a particular variable is given for an embodiment, an additional embodiment can be created using a subrange or individual values that are contained within the range. Moreover, when a value, values, a range, or ranges for a particular variable are given for one or more embodiments, an additional embodiment can be created by forming a new range whose endpoints are selected from any expressly listed value, any value between expressly listed values, and any value contained in a listed range. For example, if the application were to disclose an embodiment in which a variable is 1 and a second embodiment in which the variable is 3-5, a third embodiment can be created in which the variable is 1.31-4.23. Similarly, a fourth embodiment can be created in which the variable is 1-5.

As used herein, examples of "substantially" include: "more so than not," "mostly," and "at least 30, 40, 50, 60, 70, 80, 90, 95, 96, 97, 98 or 99%" with respect to a referenced characteristic. With respect to vectors, directions, movements or angles, that are "substantially" in the same direction as or parallel to a reference vector, direction, movement, angle or plane, "substantially" can also mean "at least a component of the vector, direction, movement or angle specified is parallel to the reference vector, direction, movement, angle or plane," although substantially can also mean within plus or minus 45, 40, 35, 30, 25, 20, 15, 10, 5, 4, 3, 2, or 1 degrees of the reference vector, direction, movement, angle or plane.

As used herein, examples of "about" and "approximately" include a specified value or characteristic to within plus or minus 30, 25, 20, 15, 10, 5, 4, 3, 2, or 1% of the specified value or characteristic.

While this invention has been particularly shown and described with reference to exemplary embodiments, it will be understood by those skilled in the art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A perforating gun system comprising:

at least two gun sections coupled together at corresponding first ends through an adapter so that one of the at least two gun sections is angularly offset relative to another of the at least two gun sections; and a spacer attached with one end to a second end of each of the at least two gun sections, each spacer configured to extend radially from the at least two gun sections so that another end of each spacer is free, the spacer and the adapter configured to position each gun section adjacent to a corresponding circumferential arc of an inner surface area of a well casing, to reduce a water gap between each gun section and the corresponding circumferential arc, wherein the corresponding circumferential arc of the inner surface area of the well casing is different for the at least two gun sections.

2. The perforating gun system of claim 1 wherein each of the at least two gun sections is configured to be angularly offset relative to adjacent ones.

3. The perforating gun system of claim 1 wherein the at least two gun sections are coupled together such that an axial center line of each gun section is mechanically adjustable relative to an axial centerline of adjacent gun sections.

4. The perforating gun system of claim 1 wherein each of the at least two gun sections is configured to perforate different circular arc sections of the inside surface of the well casing.

5. The perforating gun system of claim 1 wherein each of the at least two gun sections is configured to create new perforations without overlapping perforations made from another of the at least two gun sections.

6. The perforating gun system of claim 1 wherein each of the at least two gun sections is configured to create new perforations overlapping at least one perforation made from another of the at least two gun sections.

7. The perforating gun system of claim 1 wherein a cross-section of the perforating gun system has an overall outer diameter that is equal to an inner diameter of the well casing.

8. The perforating gun system of claim 1 wherein the perforating gun system is deployed with tubing conveyed perforating.

9. The perforating gun system of claim 1 wherein the perforating gun system is deployed with coil tubing.

10. The perforating gun system of claim 1 wherein a number of individual guns in each of the at least two gun sections ranges from 2 to 20.

11. The perforating gun system of claim 1 wherein a number of gun sections in the perforating gun system ranges from 2 to 3.

12. The perforating gun system of claim 1 wherein the predetermined position spans an interval of perforating ranges from 20 feet to 600 feet.

13. The perforating gun system of claim 12 wherein the adapter and the spacer are sized so that a percentage of a well casing removal in the interval ranges from 1.5 to 10 after the dun system is fired.

14. The perforating gun system of claim 1 wherein an outer diameter of each of the at least two gun sections ranges from 5 inches to 12 inches.

15. The perforating gun system of claim 1 wherein a range of angular offset of each of the at least two gun sections with respect an adjacent gun section ranges from 0 degrees to 180 degrees.

16. The perforating gun system of claim 1 wherein each of the at least two gun sections are individually actuated.

17. The perforating gun system of claim 1 wherein each of the at least two gun sections are armed by hydrostatic pressure in the well casing.

18. The perforating gun system of claim 1 wherein each of the at least two gun sections are armed using one or more timers.

19. The perforating gun system of claim 1 wherein each of the at least two gun sections are connected to one or more control lines.

20. The perforating gun system of claim 1 wherein a portion of a circumference of each of the at least two gun sections are overlapping with circumferences of other gun sections within the well casing.

21. The perforating gun system of claim 1 wherein each gun section of the at least two gun sections is capable of a shot density of about 12 to 20 shot per foot.

22. A perforating method comprising the steps of:

(1) providing a perforating gun system comprising at least two gun sections coupled together at corresponding first ends through an adapter so that, one of the at least two gun sections is angularly offset relative to another of the at least two gun sections;

(2) deploying the gun system into a well casing;

(3) positioning a first gun section of the at least two gun sections at the predetermined position in the well casing, a second end of the first pun section being attached to an end of a first spacer, the first spacer being configured to extend radially from the first gun section so that another end of the first spacer is free, and the first spacer is configured to position the first gun section adjacent to a first circumferential arc of an inner surface area of the well casing, to reduce a first water gap between the first gun section and the first circumferential arc of the inner surface area of the well casing;

(4) perforating an interval of the well casing with the first gun section;

(5) moving a next gun section in the at least two gun sections to the predetermined position in the well casing, a second end of the next gun section being attached to an end of a second spacer, the second spacer being configured to extend radially from the next gun section so that another end of the second spacer is free, and the second spacer is configured to position the next gun section adjacent to a second circumferential arc of the inner surface area of the well casing, to reduce a second water gap between the next gun section and the second circumferential arc of the inner surface area of the well casing;

(6) perforating the predetermined position with the next gun section; and (7) repeating steps (5) and (6) until all the gun sections perforate at the predetermined position, wherein the first circumferential arc is different from the second circumferential arc.

23. The perforation method of claim 22 wherein the step of perforating (4) includes detonating the first gun section.

24. The perforation method of claim 23 wherein the step of perforating (4) includes detonating the first gun section using a hydraulic connection.

25. The perforation method of claim 22 wherein the predetermined position in the well casing is at a point where a well is to be sealed and abandoned.

26. The perforation method of claim 22 further comprising the step of repositioning the perforating gun system without rotating the perforating gun system.

27. The perforation method of claim 22 further comprising the step of orienting each of the gun sections with respect to one another.

28. The perforation method of claim 22 wherein each of the at least two gun sections is fully loaded.

29. The perforation method of claim 22 wherein each of the at least two gun sections is partially loaded.

30. The perforation method of claim 22 wherein each of the at least two gun sections uses a spiral phasing of charge.

* * * * *